US006145829A

United States Patent [19]

Furmanski et al.

[11] Patent Number: 6,145,829

[45] **Date of Patent: *Nov. 14, 2000**

[54] PROCESS AND DEVICE FOR SELECTING A SINGLE STACKED FLAT OBJECT FROM A STACK AND USE IN PACKAGING OF CIGARETTES

[75] Inventors: Horst Furmanski; Ehrhard Gehrke; Kamal Maheronnaghch, all of Berlin, Germany

[73] Assignee: Phillip Morris Incorporated, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/928,102

[22] Filed: Sep. 12, 1997

Related U.S. Application Data

[63] Continuation-in-part of application No. 08/630,656, Apr. 10, 1996, abandoned.

[30] Foreign Application Priority Data

Oct. 9, 1996 [DE] Germany ..... 196 41 605

[51] Int. Cl.[7] ..... B65H 5/08

[52] U.S. Cl. ..... 271/11; 271/99; 271/100; 271/104; 271/106; 271/132; 271/137

[58] Field of Search ..... 271/11, 14, 16, 271/20, 100, 104, 132, 133, 137, 99, 10.03

[56] References Cited

U.S. PATENT DOCUMENTS

| | | | |
|---|---|---|---|
| 1,665,937 | 4/1928 | Bridgman . | |
| 2,331,533 | 10/1943 | Bishop | 271/32 |
| 3,279,788 | 10/1966 | Shields | 271/32 |
| 3,675,387 | 7/1972 | Lekan | 271/132 |
| 3,782,716 | 1/1974 | Long et al. | 271/99 |
| 3,973,768 | 8/1976 | Shannon | 271/99 |
| 5,195,732 | 3/1993 | Focke | 271/11 |
| 5,711,518 | 1/1998 | Portaro et al. | 271/10.03 |

FOREIGN PATENT DOCUMENTS

| | | | |
|---|---|---|---|
| 2071061 | 9/1981 | United Kingdom | 271/99 |

OTHER PUBLICATIONS

EP 97117459.4 (Search Report), Oct. 8, 1998.

*Primary Examiner*—H. Grant Skaggs
*Attorney, Agent, or Firm*—Clinton H. Hallman, Jr.; Kevin B. Osborne; Charles E.B. Glenn

[57] ABSTRACT

A process for selecting a single stacked flat object from a stack of flat objects. The lowermost flat object is downwardly detached from the rest of the stack of flat objects by negative pressure on at least one of its edge areas) running parallel to the take-off direction. In at least one suction area, the flat object is held by negative pressure onto a conveyor that can move back and forth. The flat object is advanced underneath a scraper and then further conveyed. The device for carrying out this process has a hopper for the stack of flat objects, a scraper, at least one suction device to partially detach the lowermost flat object, a conveyor, and a take-off device.

14 Claims, 6 Drawing Sheets

PROCESS AND DEVICE FOR SELECTING A SINGLE STACKED FLAT OBJECT FROM A STACK AND USE IN PACKAGING OF CIGARETTES

This application is a continuation-in-part of application Ser. No. 08/630,656, filed Apr. 10, 1996, now abandoned.

I. BACKGROUND OF THE INVENTION

A. FIELD OF THE INVENTION

The invention relates to a process and a device for selecting a single stacked flat object from a stack of flat objects, whereby a conveying means uses negative pressure to hold and withdraw the lowermost flat object from the stack of flat objects.

B. DESCRIPTION OF THE RELATED ART

Such a device is generally known in concept from U.S. Pat. No. 3,782,716. The selection device described therein has a transport carriage whose two side sections are inclined downwardly. In both side sections, there are several openings which are uniformly distributed over the entire length of the side sections. In order to select a single flat object, a vacuum is applied to the lowermost flat object through the openings made in the downwardly inclined side sections, whereby the edge areas of the lowermost flat object are bent downwards and fixed onto the side sections of the transport carriage.

Then the carriage starts to move laterally and the lowermost flat object, fixed onto the carriage, is selected underneath a scraper. Behind the scraper, the lowermost flat object, which has then advanced, is transferred to a roller, for which purpose the vacuum has to be switched off. The carriage then returns to its starting position, the vacuum is switched on again and the selection process is repeated. Due to the control required for the vacuum, it is only possible to achieve low selection speeds (approximately 250 units per minute) with such an apparatus.

C. OBJECT OF THE INVENTION

Therefore, an objective of the present invention is to create a process and a device that allow a higher selection speed, accuracy of placement, and fewer machine faults and jams.

II. SUMMARY OF THE INVENTION

This objective is achieved by the process according to the invention. In the present apparatus for selecting a single stacked flat object, the lowermost flat object is first downwardly detached from the rest of the stack of flat objects by negative pressure on at least one of its edge areas running parallel to the take-off direction.

In at least one suction area, the flat object is held by negative pressure onto a conveying means that can move back and forth, is advanced underneath a scraper and further conveyed. The negative pressure is continuously applied during the back and forth motion of the conveying means.

The distance between the suction area and the back edge of the lowermost flat object held during the forward motion, the timing and the speed of the back and forth motion of the conveying means and the timing and the speed of the further conveying of the lowermost flat object are coordinated with each other in such a way that the conveying means has reached its back final position or started its forward motion at about the point in time when the back edge of the lowermost flat object, which has then advanced, starts to clear the suction area.

In the process according to the invention (and in the device according to the invention)—the length of the back section of the conveying means, which is free of suction openings, the timing and the speed of the back and forth motion of the conveying means as well as the timing and the speed of the further conveyance of the lowermost flat object are carefully coordinated.

The lowermost flat object functions as a kind of vacuum slide valve between the openings through which the negative pressure is applied and the second-to-last flat object. The vacuum can only upon the next-to-last flat object once the conveying means is already making a forward motion or, preferably, once it has returned to its back position when the lowermost flat object is withdrawn completely.

It is also possible in another embodiment that, at the point in time when the suction openings are cleared by the lowermost flat object in question, the conveying means is still making its backward motion. However, this entails the risk that the next-to-last flat object will then be pushed towards the back, for example, against a retainer, when the backwards motion ends, and that said flat object will crumple.

Therefore, it is preferable in one embodiment for the conveying means to have reached its back (retracted) position at the latest when the back edge of the lowermost flat object, which has then advanced, starts to clear the suction area. Therefore, the vacuum can be maintained constantly and does not have to be switched on and off for each selection step by a valve control element. This has the advantage that much higher selection speeds of 700 to 800 units or more per minute can be achieved with the process according to the invention.

At the same time, as a result of the partial detachment of the lowermost flat object from the flat object above it and the ejection underneath the scraper, a neat separation of the lowermost flat object is achieved, so that there is no risk that the lowermost flat object will be removed together with the flat object located immediately above it.

Preferably, the detachment of the lowermost flat object by the applied negative pressure and the fixing of this partially detached flat object onto the conveying means is effectuated by the same suction area or by the same openings in the top of the conveying means through which the negative pressure is applied to the lowermost flat object, since this is the easiest way to carry out the process.

It is also preferred for the lowermost flat object to be flexed or bent by negative pressure along a line running in the take-off direction, as a result of which a good partial detachment from the flat objects above it is achieved.

Thanks to the detachment of both edge areas of the lowermost flat object, a better stabilization and thus adhesion is achieved when the flat object is withdrawn.

The invention is explained with reference to an exemplary embodiment. The following is shown with reference to the figures. It should be noted that many modifications will now become apparent to one of skill in the art having regard for this disclosure. The scope of protection should, therefore, be determined by reference to the claims only.

III. BRIEF DESCRIPTION OF THE DRAWINGS

IV. DETAILED DESCRIPTION OF THE PREFERRED EMBODIMENTS

Figure 1:
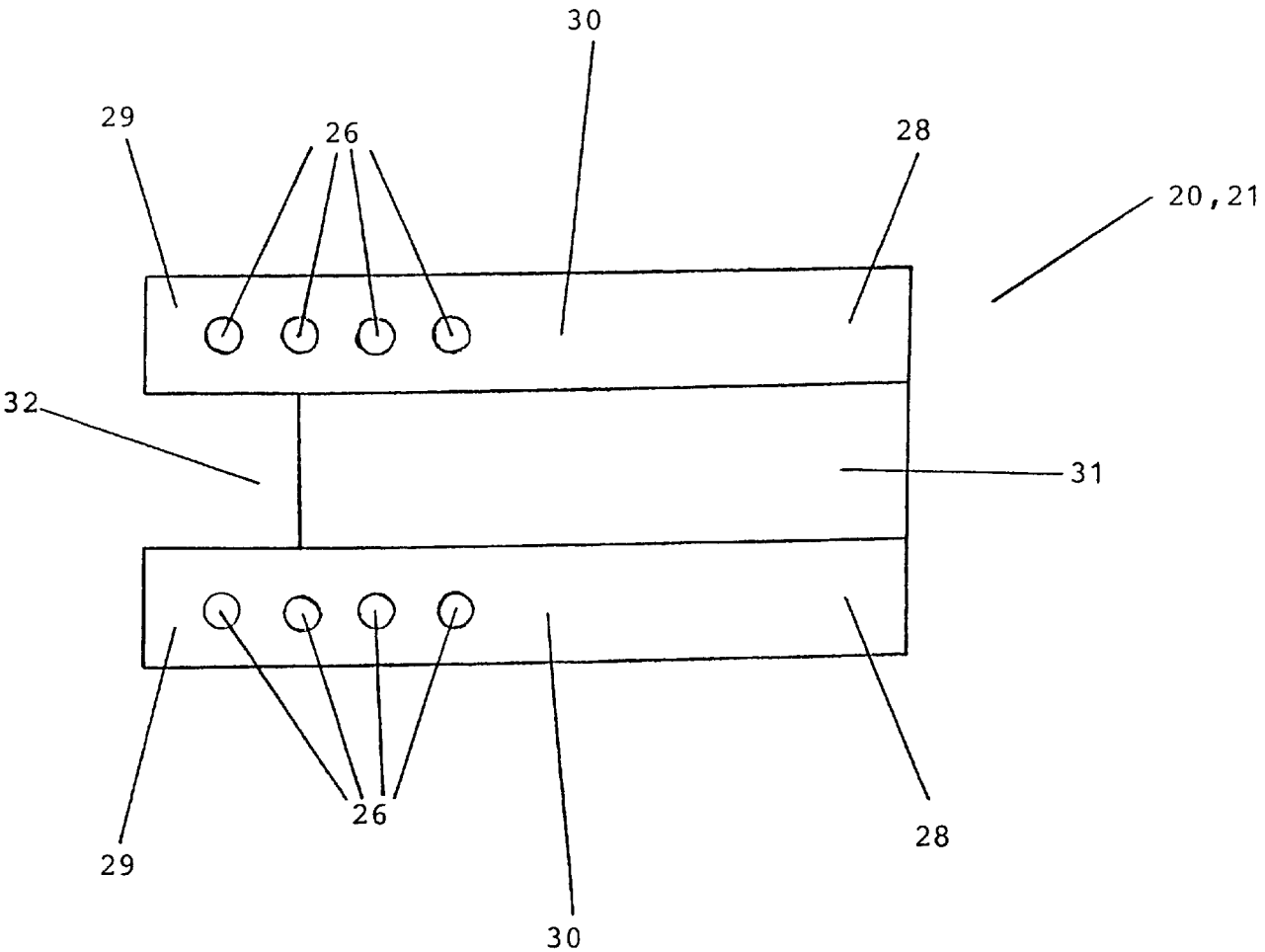
FIG. 1 is a top view of an exemplary conveying means.

FIG. 1 shows a top view of an exemplary conveying means 20 in the form of a transport carriage 21. The transport carriage 21 has a flat middle section 31 as well as the two side sections 30 which are, in turn, each divided into two sections. Both of the side sections 30 have a front section 29, each having up to four openings 26 through which the negative pressure can be applied, as well as a back section 28 that is free of openings 26. Finally, the transport carriage 21 has a recess 32 on its front in order to facilitate the transfer of a flat object, which has then advanced, and is not shown here but is illustrated in other drawings, e.g. FIG. 8.

Figure 2:
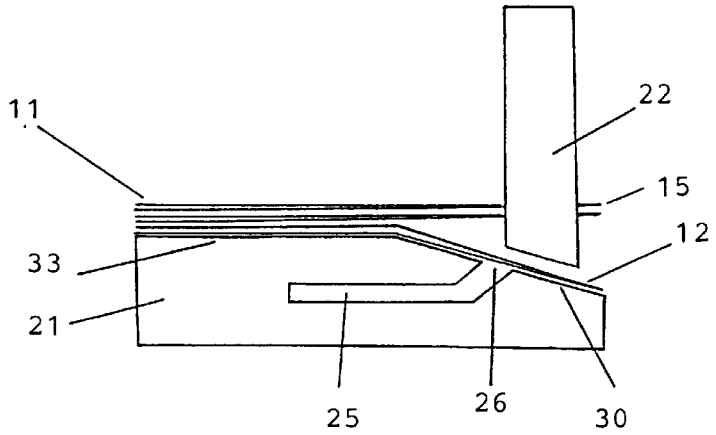
FIG. 2 is a front view of a selection device according to the present invention viewed perpendicular to the conveying direction, with a side section sloped on one side.

FIG. 2 shows a selection device with a stack 11 of flat objects consisting of only three flat objects. The flat objects are thin, two-layer coupons that are folded along their lengthwise edge 15. The stack 11 of flat objects (in a hopper not shown here) lies on a transport carriage 21 that has a flat section 33 and a laterally downwardly inclined side section 30. The transport carriage 21 is supported in a known manner on rails or on some other guide element so that it can slide linearly and it is driven by a drive mechanism not shown here. The path of motion of the transport carriage 21 is inclined downwards at an angle of about 30°.

The hopper (not shown, but illustrated in other drawings, e.g. FIG. 8) is inclined forward in the same manner as the path of the transport carriage 21, so that the intrinsic weight of the stack 11 of flat objects causes it to lie against a scraper 22 consisting of a rod whose lower end is beveled. This scraper 22 is arranged perpendicularly to the direction of motion of the transport carriage 21.

In its downwardly inclined side section 30, the top of the transport carriage 21 has a vacuum or suction opening 26 that is connected by a duct system 25 to a source of negative pressure (not shown). As can be seen in FIG. 2, a negative pressure is applied to the suction opening 26 so that the lowermost flat object 12 is aspirated and fixed onto the downwardly inclined side section 30. When the transport carriage 21 is advanced, the fixed lowermost flat object 12 can easily be ejected underneath the scraper 22 and further conveyed.

Figure 3:
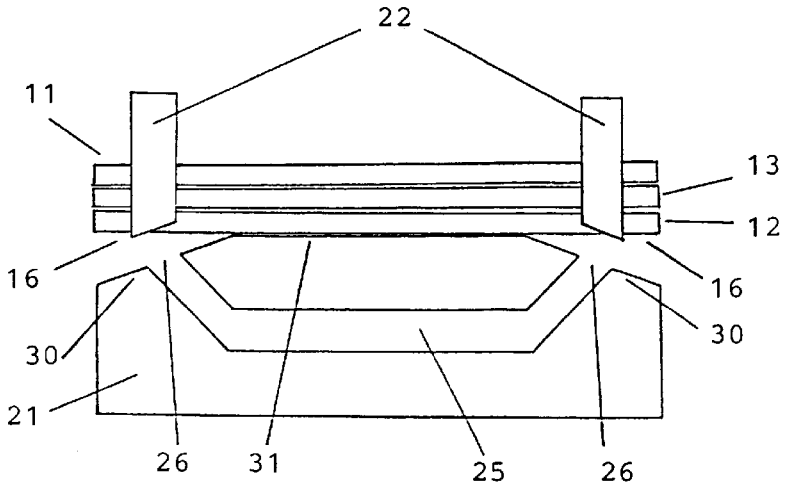
FIG. 3 is a front view of a device according to the present invention illustrating an embodiment with two sloped side sections before the selection of the lowermost flat object.

FIG. 3 illustrates a front view of a transport carriage 21 that has a flat middle section 31 with two downwardly inclined side sections 30, with a stack 11 of flat objects consisting of three somewhat thicker, one-layer flat objects. The downwardly inclined side sections 30 have suction openings 26 to which vacuum can be applied through the vacuum system 25. FIG. 3 shows the device before vacuum is applied so that the edge areas 16 of the lowermost flat object 12 are not yet detached from the edge areas of the second-to-last flat object 13.

FIG. 4 again shows the transport carriage 21 of FIG. 3 with a flat middle section 31 and the side sections downwardly inclined on both sides 30, the suction openings 26 and the duct 25. The vacuum is now switched on so that the lowermost flat object 12 is aspirated onto the surface of the transport carriage 21. Through the application of the vacuum, both edge areas 16 of the lowermost flat object 12 are flexed along a line running in the take-off direction, and the lowermost flat object 12 is forced to adapt its originally rigid and straight shape to the flexed cross section of the transport carriage 21.

As a result, the edge areas 16 are separated from the next flat object 13. When the transport carriage 21 is advanced, the lowermost flat object 12 is taken along since it is held by the transport carriage 21 as a result of the negative pressure generated by the vacuum system. The front edge of the flat object 13 above it rests against the scraper 22 and its lower edge, in turn, runs parallel to the downwardly inclined side sections 30 and consequently, it cannot move along with the transport carriage 21 so that, due to the advancing of the transport carriage 21 and the resultant ejection of the lowermost flat object 12 underneath the scrapers 22, the lowermost flat object 12 is selected reliably and without problems.

Figure 4:
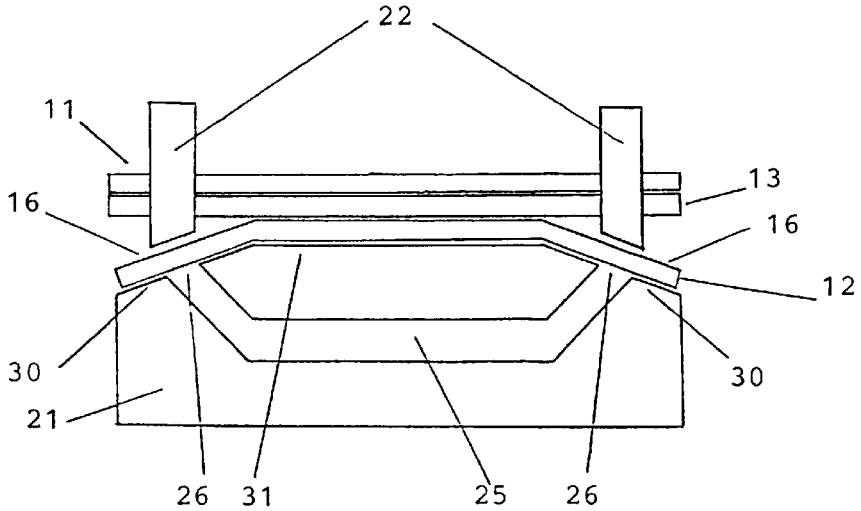
FIG. 4 illustrates the device according to FIG. 3 during the selection process.

FIGS. 3 and 4 also show that it is not necessary to adjust the scraper 22 very precisely since, due to the vacuum system, only the lowermost flat object can be selected. It is reliably prevented that the subsequent flat object is carried along.

Figure 5:
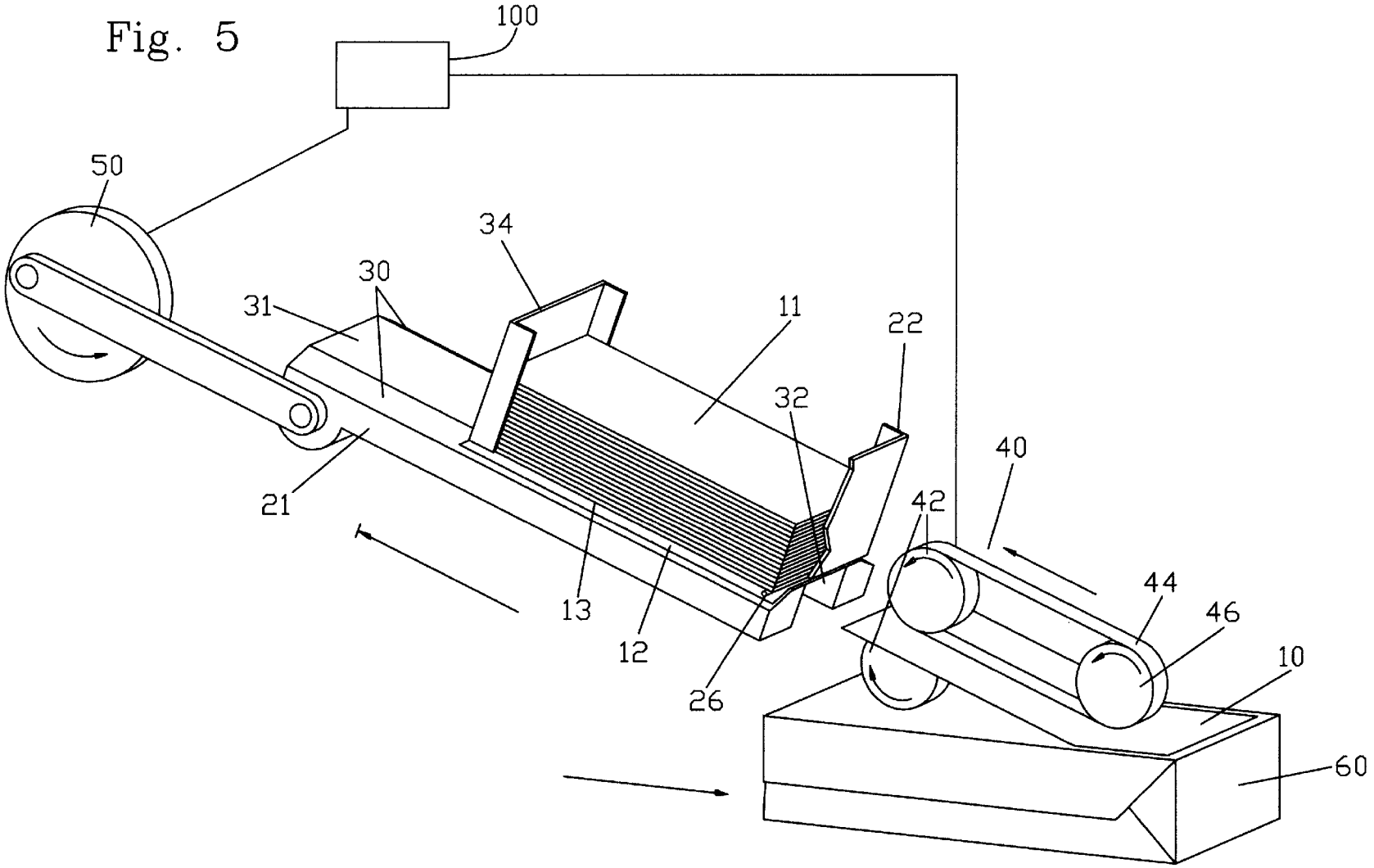
FIG. 5 is a side view of a device during a stage of the selection process in an embodiment of the present invention.

FIGS. 5 through 8 show various stages of the selection process. Each of these stages is coordinated by controller 100. FIG. 5 shows the first step in the selection process. It shows a transport carriage 21 with the two downwardly inclined side sections 30 and the flat middle section 31. In FIG. 5, the transport carriage 21, which is driven by a crank drive 50, is in its back position, as is indicated by the motion arrow which ends at a short perpendicular line. A suction air opening 26 can also be seen on the front of one side section 30. The second side section 30 also has such a suction air opening 26, but this cannot be seen in FIG. 5. Finally, the transport carriage 21 also has a recess 32. On the transport carriage 21, there is a stack 11 of flat objects consisting of paper coupons whose front rests against a scraper 22 that is only partially shown.

At the back of the stack 11 of flat objects, there is a retainer 34. As can be seen in FIG. 5, the lowermost flat object 12 is fixed by the applied vacuum onto the surface of the transport carriage 21, and the edge areas of the lowermost flat object 12 are detached from the next flat object 13.

In front of the transport carriage 21, there is a take-off device 40 having two counter-rotating transfer rollers 42, of the conveyor belt 44 and of another roller 46. In FIG. 5, a selected flat object 10 is just being placed onto an unfinished cigarette pack 60 having an inner liner and being transported on a conveyor belt, not shown here.

Figure 6:
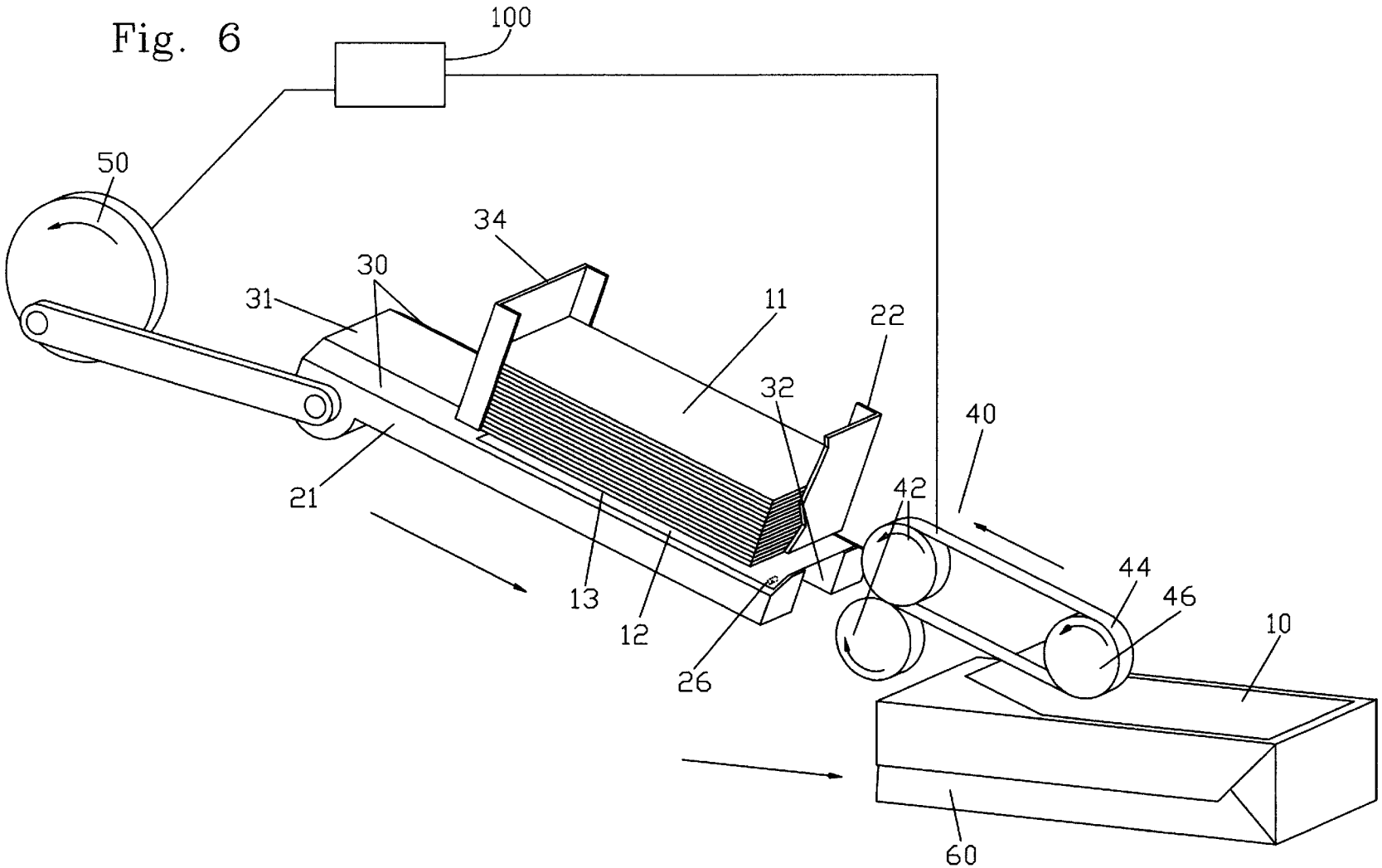
FIG. 6 is a side view of a device during a stage of the selection process in an embodiment of the present invention.
Figure 8:
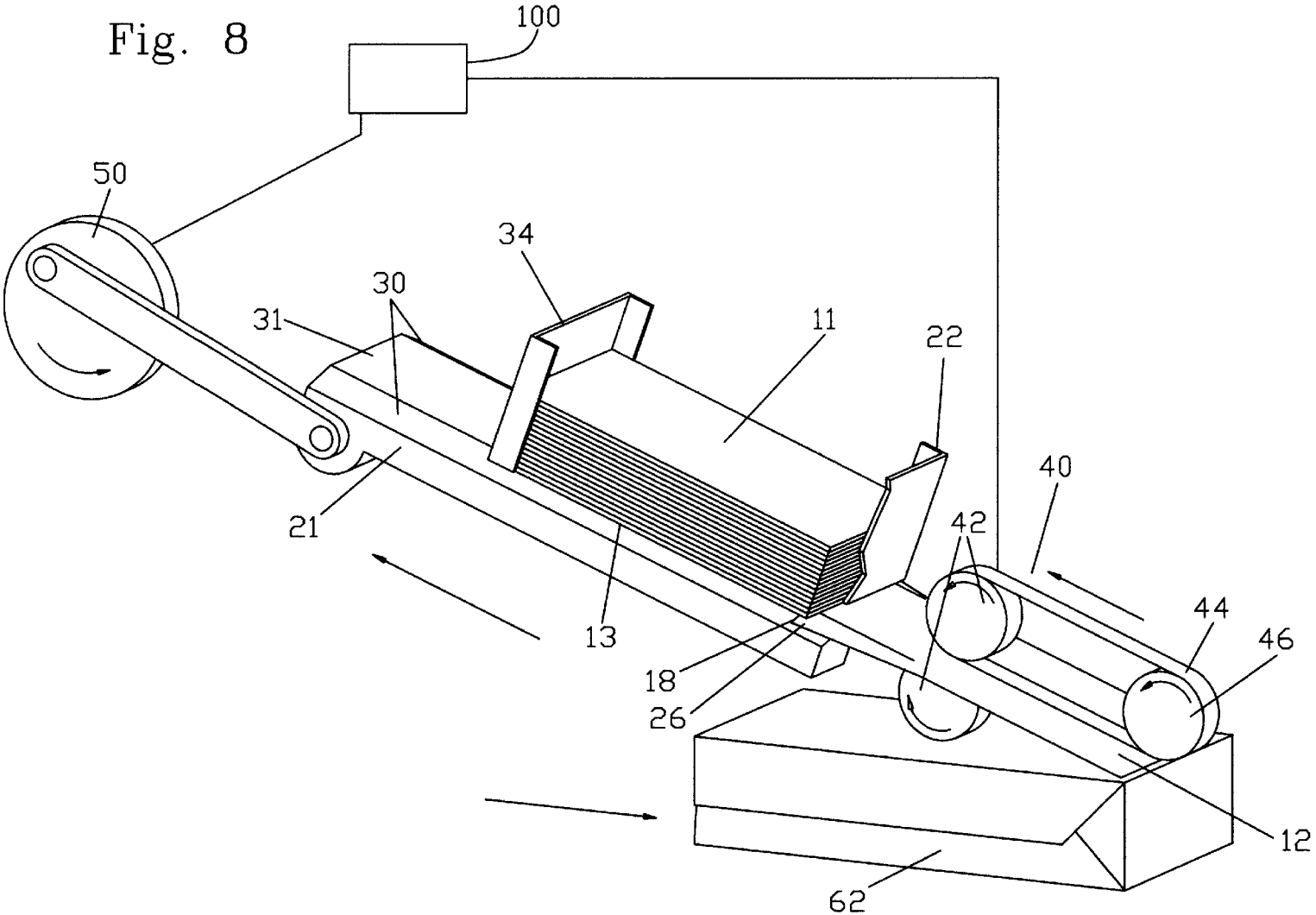
FIG. 8 is a side view of a device during a stage of the selection process in an embodiment of the present invention.

In FIG. 5 as well as in FIGS. 6 and 8, the arrows show the directions of motion (for example, of the transfer rollers 42, of the conveyor belt 44 or of the crank drive 50) (also see above).

FIG. 6 shows the second step of the selection. The carriage 21 has now been advanced a bit by the crank drive 50 so that the fixed lowermost flat object 12 underneath the scraper 22 has already been ejected a short distance and is separated from the second-to-last flat object 13, but has not yet reached the take-off device 40. At the end of the take-off device 40, the placement of the already selected flat object 10 on the cigarette pack 60 is almost completed.

Figure 7:
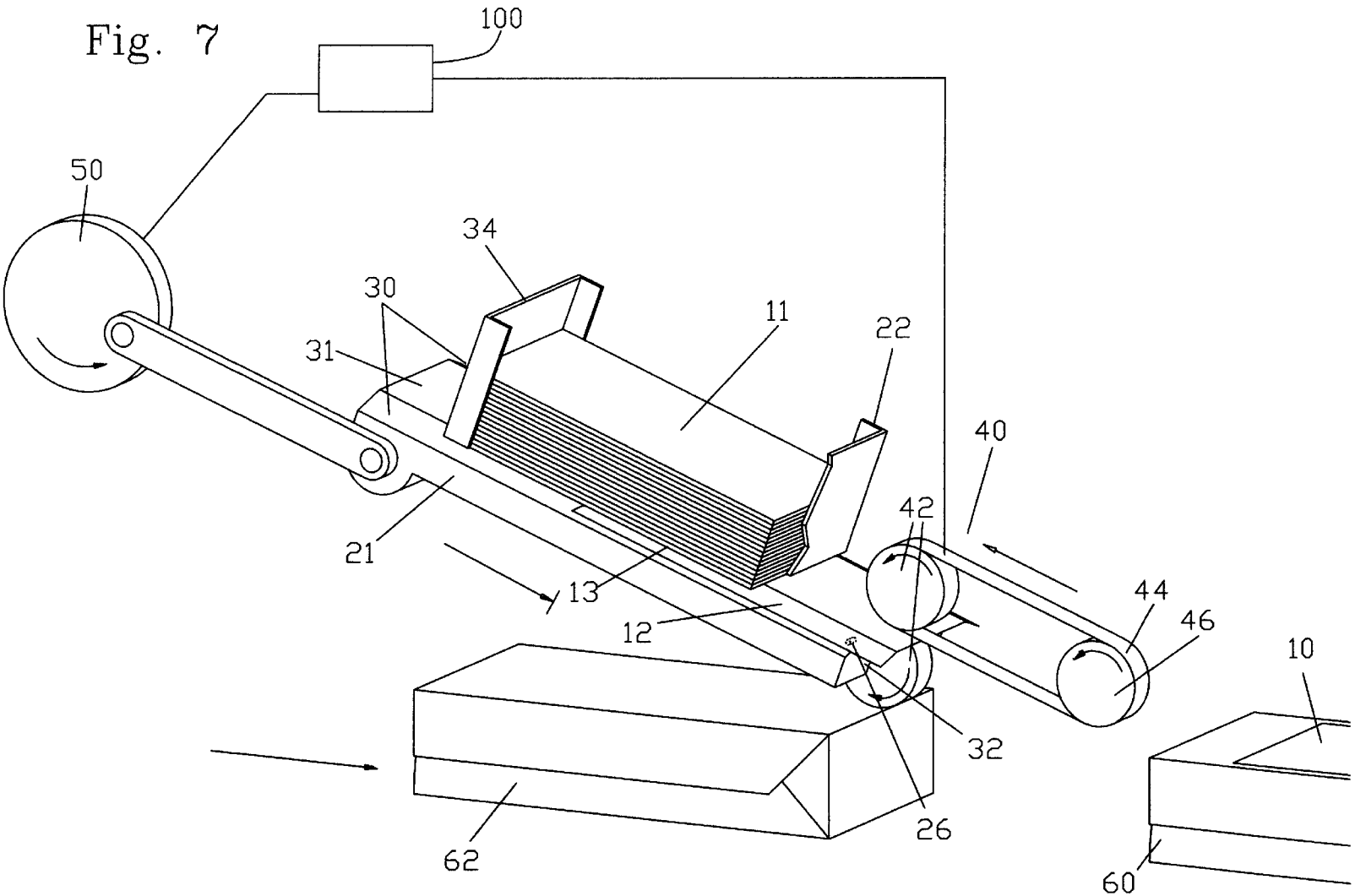
FIG. 7 is a side view of a device during a stage of the selection process in an embodiment of the present invention.

In FIG. 7, the carriage has finally reached its maximum forward position, which is indicated by the motion arrow of the transport carriage 21 which ends at a short perpendicular line. It can be clearly seen that the application of suction air through the suction opening 26 is still acting exclusively on the lowermost flat object 12. This lowermost flat object 12 is now between the transfer rollers 42, whereby the lower transfer roller 42 is, in turn, positioned in the recess 32 of the transport carriage 21.

In this manner, a good transfer of the selected flat object 12 is possible. The placement of the already selected flat object 10 onto the cigarette pack 60 (on the right-hand side of FIG. 7) is completed while a second cigarette pack 62 meant for the just selected flat object 12 is being transported to that the transfer can take place.

FIG. 8 shows the next step of the selection, whereby the carriage 21 is already making its backward motion and is shortly before the back starting position. As can be seen in FIG. 8, the lowermost flat object 12 is now located largely in the take-off device 40 and just before placement onto the cigarette pack 62. The back end of the flat object 12, however, is still covering the suction opening 26, i.e. the back edge 18 of the flat object 12 has not yet cleared the suction opening 26 so that no vacuum is acting upon the next-to-last flat object 13. Immediately before the transport carriage arrives in its back starting position, the lowermost flat object 12 still acts as a vacuum slide valve by blocking the vacuum suction holes.

The next step then corresponds again to the situation shown in FIG. 5, whereby instead of the flat object 10 selected there, the flat object 12 is now being selected and the next flat object 13 is being separated from the rest of the stack 11 of flat objects.

The flat objects employed can be any kind of flat objects, but at least one of the edge areas has to be flexible. Examples of flat objects that can be employed are paper blanks (e.g. coupons, inserts, wrappers, stamps), cardboard blanks as well as plastic blanks (e.g. made of polyvinyl chloride or of a plasticizer-free vinyl chloride-vinyl acetate copolymer). Preferably, a flat object made of plastic will be a flexible card (white or colored and, if desired, provided with the usual features of a bank card such as a magnetic strip or a signature field) in the form of a conventional bank card with a size that is the same as or smaller than or bigger than the size of a normal bank card.

Special preference is given to coupons, for example, made of paper, having a size of approximately 7.5 cm by 4.5 cm which are suited as inserts for cigarette packs. These coupons can have one layer, two layers or multiple layers. For example, a coupon with a length of approximately 22.5 cm by 4.5 cm can be folded together into a three-layer coupon whose dimensions are 7.5 cm by 4.5 cm. Another alternative is a coupon with a length of 15 cm and a width of 9 cm that is folded once lengthwise and once crosswise to form a (four-layer) coupon, once again with dimensions of 7.5 cm in length n 4.5 cm in width. These coupons can then be added to cigarette packs using the process according to the invention and the device according to the invention.

The device according to the invention encompasses a hopper for the stack of flat objects, a scraper, at least one suction device for the downward detachment of at least one edge area—running parallel to the take-off direction—of the lowermost flat object, a conveying means for the selected flat objects that is supported in such a way that it can slide underneath the hopper, so that a stack of flat objects placed into the hopper lies on the conveying means, and a take-off device to grasp and further convey the lowermost flat object, which has then advanced.

The hopper can be, for example, a loading shaft with continuous walls or preferably with individual, narrow upright fingers having a front—as seen in the conveying direction—and, on the opposite side, a retainer whose height and length with respect to the conveying direction can be adjusted. The retainer should extend below the lower edge of the stack of flat objects in order to avoid the ejection of a flat object towards the back when the conveying means moves backwards.

The scraper facilitates the final separation of the lowermost, partially detached, flat object from the rest of the stack of flat objects. This scraper can either be an autonomous element of the device or part of the hopper. For example, the scraper can constitute the front of the hopper. The scraper should extend at least as far as the lower edge of the second-to-last flat object so that, after the fixing of the lowermost flat object, thus preventing the simultaneous ejection of another flat object due to adhesion between the two bottom layers, in spite of the separation of the edge area or edge areas that has already been effectuated.

Preferably, however, in the area of the downwardly inclined side sections of the conveying means, the scraper extends all the way to below the lower edge of the stack of flat objects. It is optimal for the distance between the surface of the side section(s) of the conveying means and the lower edge of the scraper to be slightly greater than the thickness of the flat object to be selected. A precise adjustment of the scraper is not necessary since a separation has already been achieved by the vacuum fixing and moreover, the distance between the upper edge of the lowermost fixed flat object and the lower edge of the next flat object is relatively large in the area of the downwardly inclined side section(s). Moreover, the adjustment range depends on the degree of sloping of the side section(s) chosen in a given case. The scraper can have a one-piece design, for example, it can be U-shaped, whereby optionally the lower ends of the U-shaped scraper are beveled. However, the scraper can also consist of two separate parts, whereby the lower ends can, once again, be beveled so as to correspond to the downwardly inclined side sections of the conveying means.

The suction device serves to detach one or both edge areas of the lowermost flat object. This suction device can be a device connected to a conventional source of vacuum. Preferably, however, the suction device is part of the conveying means described in greater detail below.

The conveying means, which can move back and forth and which is preferably a carriage that can be driven in a conventional manner (for example, by means of a crank drive), serves to advance the lowermost flat object. For this purpose, the top of the conveying means has at least one opening that can be connected to a device employed to generate negative pressure, so that the lowermost flat object is held onto the conveying means during the forward motion. The opening or openings through which the negative pressure is applied to the lowermost flat object are located in the front section of the conveying means (preferably in the front half, especially in the front one-third, especially preferably in the front one-tenth), whereas the back section does not have any openings. The opening or openings provided in the conveying means are connected to a vacuum or suction device and, as a rule, are circular, with a diameter ranging from, for example, 1 mm to 1 cm. Any kind of vacuum generation system such as, for example, a water jet pump, can be used for this purpose.

Preferably, the conveying means openings through which vacuum is applied not only fix the lowermost flat object and advance it underneath the scraper but rather, at the same time, the opening or openings also serve to detach at least one edge area of the lowermost flat object. In this case, the opening or openings are then located in one or both side sections of the conveying means, whereby the back sections of these side sections are, once again, free of openings.

The number and size of the suction openings depends, of course on the intrinsic stability and size of the flat object to be selected in each case. The higher the intrinsic stiffness and the larger the size of the flat object, the more numerous and the larger the openings have to be. For the preferred paper coupons described above having a size of approximately 4.5 cm by 7.5 cm, 1 to 4 openings in the front one-fourth, preferably one opening in the front one-tenth of the side section(s) of the conveying means, are sufficient to effectuate a detachment and secure fixation.

Therefore, the conveying means preferably has one or two downwardly inclined side sections running parallel to the conveying direction, in whose front sections there are one or more openings to which the vacuum is applied, so that the lowermost flat object is first detached and then held onto the conveying means. One of skill in the art having regard for this disclosure can select a conveying means sloped on one side or on both sides of the side sections; in each instance the selection depends on the flat object to be selected in the case in question.

If, for example, a coupon is to be selected which is folded along its lengthwise edge, i.e. parallel to the conveying direction, then a one-sided sloping of the conveying means is preferred, namely, on the side of the fold. The reason for this is that, if both sides are sloped, then the entire coupon will be detached by the negative pressure on the folded side, but on the opposite side, only the lowermost sheet of the folded coupon will be detached and not the top sheet, to which no vacuum is applied.

Therefore, during the subsequent selection process, there is a risk that the coupon will get stuck on the scraper, especially if the scraper extends all the way to the lower edge of the lowermost flat object. In the case of one-layer or multi-layer coupons that are not folded in the lengthwise direction or conveying direction, however, the conveying means is preferably sloped on both sides since, in this manner, the fixation and separation can be carried out with the fewest problems.

If the conveying means is sloped on one side, it has a flat side section that makes up about 30 to 80 percent, preferably 40 to 70 percent, of the total width of the carriage as well as a second downwardly inclined side section. If the conveying means is sloped on both sides, the top of the conveying means has a flat middle section that generally makes up 30 to 70 percent of the total width of the carriage, as well as two side sections that are usually equal in width and usually symmetrically inclined downwards. The middle section can be continuous or can consist of two or more areas.

The angle of the downwardly inclined side section(s) is 5° to 20°, preferably about 10° (depending on the stiffness of the material of the flat object to be selected) with respect to the plane of the flat side section or of the flat middle section. The downwardly inclined side section(s) can also be rounded off, which allows a good fixation of the flat object onto the conveying means.

The width of the conveying means corresponds approximately to the width of the flat object in question. The length of the conveying means is approximately the same as the length of the flat object plus the segment traversed during the ejection or even longer. In this manner, the flat objects remaining in the hopper are prevented from falling out or dropping down.

The length of the conveying means can also be somewhat shorter. In particular, it is preferred for the front edge of the conveying means—when it is, for example, in the back position and before the fixation and the ejection of the lowermost flat object—not to extend all the way to the back edge of the front wall of the hopper, so that the fixed flat object extends a bit beyond the front edge of the conveying means, for example, 0.5 mm to 3.0 mm.

This facilitates the transfer of the fixed flat object to the take-off device after the ejection. Further measures for facilitating the transfer of the flat object located on the conveying means include beveling the bottom of the front edge of the conveying means as well as slanting it towards the front, for example, at an angle of 20° to 50° vis-à-vis the horizontal plane. (The conveying means can, of course, also be horizontal or slanted towards the back.) The transfer can also be effectuated by an adaptation of the front of the conveying means to the take-off device which further conveys the selected flat objects.

This take-off device is normally located just before the scraper and, as a rule, consists of two conventionally driven transfer rollers. Then the conveying means, which advances the flat object to be selected underneath the scraper, has a recess on its front whose size is adapted to the transfer rollers. During the advancing step, the conveying means positions the flat object to be selected between the two transfer rollers which then take up the flat object and further convey it. In this manner, the path traversed by the flat object is much shorter than the length of this flat object. For the preferred paper coupons described above, the length of travel is about 40 mm, while it is only 25 mm, for example, for the somewhat smaller tax stamps used for cigarette packs.

When the lowermost flat object is selected, first of all, vacuum is applied to it through the suction openings preferably located in the side sections. As a result of the application of this vacuum, the lowermost flat object is aspirated onto the conveying means and consequently fixed onto its supporting surface. During this fixation, the flat object loses the flat and rigid shape created by its intrinsic stiffness and assumes the contour of the conveying means. Hence, in addition to being fixed, the lowermost flat object is also separated from the next-to-last flat object.

The conveying device now travels underneath the scraper and transfers the lowermost flat object to the transfer rollers, whereby the conveying means is already moving backwards again. Since there are no openings in the back section of the conveying means, no vacuum is applied to the next-to-last flat object at this point in time. The timing and the speed of the back and forth motion, the timing and the speed of the take-off device (which are both preferably continuous but can also be discontinuous) and the length of the back section of the conveying means that is free of suction openings are coordinated with each other in such a way that the conveying means is preferably at least in its back position when the lowermost flat object starts to clear the suction openings.

The conveying device or carriage can also still be making its backward motion when the suction openings are cleared. Then, as a result of the continuously operative vacuum, however, the lowermost flat object is already aspirated during the backward motion of the conveying means, and it can crumple against the retainer. Therefore, the suction openings should be cleared either just before the end of the backwards motion or else exactly at the back final position of the conveying means or during its forward motion, preferably when the conveying means has reached its back final position.

For this purpose, it is preferred that the suction openings are only located in the front half, especially the front one-third or the front one-tenth of the conveying means. Then, as soon as the lowermost flat object is withdrawn, the next-to-last flat object is fixed and the selection process can be repeated without there being a need to switch the vacuum on and off.

The selected flat object is then further conveyed by the take-off device. For example, coupons can be added to finished cigarette packs that have not yet been enclosed in a clear cellophane wrapper. In particular, coupons are added to cigarettes that are only wrapped in an inner liner. Then, in the usual manufacturing process for cigarette packs, the result is, for example, a cigarette hard box with a coupon between the inner liner and the outer wrapper, so that the coupon is visible to the consumer when the pack is opened, and it can then be taken out.

What is claimed is:

1. An apparatus for removing a lowermost flat object from a remaining stack of flat objects and advancing the lowermost flat object along a path to a receiving area, comprising a hopper for containing the stack of flat objects, a scraper located along the path of advancement of the flat object, a vacuum system configured to downwardly detach at least one edge area running parallel to the advancement direction of the lowermost flat object, enabling advancement of the lowermost flat object underneath the scraper, a conveyor having a flat middle section and adjoining side sections and a timing and a speed and being displaceable along a path in a back and forth motion such that the lowermost flat object is advanced, said conveyor further comprising a front section including a grouped plurality of openings and a back section that is free of openings, wherein said plurality of openings are in fluid communication with said vacuum system, a take-off device having a timing and a speed, said take off device grasping and conveying the lowermost flat object into a receiving area, and a control device, whereby the timing and the speed of the back and forth motion of the conveyor, and the timing and the speed of the take-off device, are controlled such that as the conveyor reaches its retracted position the lowermost flat object comprises a vacuum slide valve covering said grouped plurality of openings so as to prevent the application of vacuum to a flat object thereabove.

2. An apparatus according to claim 1, wherein one of said conveyor side sections is a downwardly inclined side section running parallel to the motion of the, whereby the lowermost flat object is detached from the rest of the stack of flat objects and held onto the conveyor.

3. An apparatus according to claim 2, wherein the scraper has a lower end, said lower end extending lower in the area of the downwardly inclined side section than in said middle section.

4. An apparatus according to claim 2 wherein the downwardly inclined side section is bent or rounded off.

5. An apparatus according to claim 1, wherein each of said conveyor side sections is a downwardly inclined side section, whereby the lowermost flat object is detached from the rest of the stack of flat objects and held onto the conveyor.

6. An apparatus according to claim 1, wherein the conveyor is a transport carriage.

7. An apparatus according to claim 1 wherein the conveyor and hopper are slanted downwardly towards the conveying direction.

8. An apparatus for removing a lowermost flat object from a remaining stack of flat objects and advancing the lowermost flat object along a path to a receiving area, comprising a hopper for containing the stack of flat objects, a scraper located along the path of advancement of the flat object, a conveyor having a flat middle section and adjoining side sections each of said side sections having a front section and a back section, said middle section and said side sections forming a recess located adjacent said front sections of said side sections, wherein each of said front sections of said conveyor side sections further includes a plurality of openings;

wherein said conveyor has a timing and a speed and is displaceable along a path in a backward and forward motion such that the lowermost flat object is advanced, a vacuum system being in fluid communication with at least one of said side sections and configured to downwardly detach at least one flat object edge area running parallel to the advancement direction of the lowermost flat object, enabling advancement of the lowermost flat object underneath the scraper, a take-off device having a timing and a speed, said take off device being positioned in said recess during the forward motion of said conveyor so as to grasp and convey the lowermost flat object to a receiving area, and a controller, whereby the timing and the speed of the back and forth motion of said conveyor, and the timing and the speed of said take-off device, are controlled such that said conveyor reaches its retracted position at substantially the same time when the back edge of the lowermost flat object starts to clear said vacuum system.

9. An apparatus according to claim 8, wherein said front section of said conveyor side section containing said plurality of openings is located in a front half of said side section length.

10. An apparatus according to claim 8, wherein said front section of said conveyor side section containing said plurality of openings is located in a front one third of said side section length.

11. An apparatus according to claim 8, wherein said front section of said conveyor side section containing said plurality of openings is located in a front one tenth of said side section length.

12. An apparatus according to claim 8, wherein one of said side sections is a downwardly inclined side section having a grouped plurality of openings located in said front section thereof, said openings being in communication with said vacuum system for delivering negative pressure from said vacuum system, whereby the lowermost flat object is detached from the rest of the stack of flat objects and held onto the conveyor.

13. An apparatus according to claim 8, wherein each of said side sections is a downwardly inclined side section each having a grouped plurality of openings located in said front section thereof, said openings being in communication with said vacuum system for delivering negative pressure from said vacuum system, whereby the lowermost flat object is detached from the rest of the stack of flat objects and held onto the conveyor.

14. An apparatus for removing a lowermost flat object from a remaining stack of flat objects and advancing the lowermost flat object along a path to a receiving area, comprising a hopper for containing the stack of flat objects, a scraper located along the path of advancement of the flat object, a conveyor having a flat middle section and adjoining side sections each of said side sections having a front section and a back section, said middle section and said side sections forming a recess located adjacent said front sections of said side sections, wherein each of said front sections of said conveyor side sections further includes a plurality of openings;

wherein said conveyor has a timing and a speed and is displaceable along a path in a backward and forward motion such that the lowermost flat object is advanced, a vacuum system being in fluid communication with at least one of said side sections and configured to downwardly detach at least one flat object edge area running parallel to the advancement direction of the lowermost flat object, enabling advancement of the lowermost flat object underneath the scraper, a take-off device having a timing and a speed, said take off device being positioned in said recess during the forward motion of said conveyor so as to grasp and convey the lowermost flat object to a receiving area; and a controller, whereby the timing and the speed of the back and forth motion of said conveyor, and the timing and the speed of said take-off device, are controlled such that said conveyor starts its forward motion at substantially the same time when the back edge of the lowermost flat object starts to clear said vacuum system.

* * * * *